US007934615B2

(12) United States Patent
Hoffman et al.

(10) Patent No.: US 7,934,615 B2
(45) Date of Patent: May 3, 2011

(54) CONTAINER HAVING SLIDING DOOR

(75) Inventors: Gregg Hoffman, Rockford, IL (US); Edward P. Cronin, Brodhead, WI (US); George Solowiejko, Rockford, IL (US)

(73) Assignee: J.L. Clark, Inc., Rockford, IL (US)

( * ) Notice: Subject to any disclaimer, the term of this patent is extended or adjusted under 35 U.S.C. 154(b) by 1097 days.

(21) Appl. No.: 11/668,886

(22) Filed: Jan. 30, 2007

(65) Prior Publication Data

US 2008/0035643 A1 Feb. 14, 2008

Related U.S. Application Data

(60) Provisional application No. 60/836,769, filed on Aug. 10, 2006.

(51) Int. Cl.
*B65D 43/20* (2006.01)

(52) U.S. Cl. ..... 220/254.9; 220/345.1; 220/345.4

(58) Field of Classification Search ..... 220/254.9, 220/345.1, 345.4

See application file for complete search history.

(56) References Cited

U.S. PATENT DOCUMENTS

| | | | | |
|---|---|---|---|---|
| 3,782,584 | A * | 1/1974 | Swenson et al. | 220/345.3 |
| 4,570,817 | A * | 2/1986 | Hambleton et al. | 220/345.2 |
| 4,819,829 | A * | 4/1989 | Rosten et al. | 220/345.3 |
| 5,611,451 | A * | 3/1997 | Mosior et al. | 220/345.3 |
| 6,976,577 | B2 * | 12/2005 | Devine | 206/37 |
| 2005/0199527 | A1 * | 9/2005 | Ellis et al. | 206/540 |

OTHER PUBLICATIONS

Definition of the word "slot." Dictionary.com, Dec. 2010. http://www.dictionary.com/.*

* cited by examiner

*Primary Examiner* — Anthony Stashick
*Assistant Examiner* — James N Smalley
(74) *Attorney, Agent, or Firm* — Reinhart Boerner Van Deuren P.C.

(57) ABSTRACT

A container including a base, a cover, a dispensing port, and a slider is provided. The base has a bottom, front and back walls, and a pair of side walls defining a lower portion of a storage area. The cover has a top including a generally rectangular recess, front and back walls, and a pair of side walls defining an upper portion of the storage area. The cover is operably coupled to the base to enclose the storage area. The dispensing port passes through the top of the cover within the recess. The slider is disposed within the recess, operably coupled to the cover, and moveable within the recess from a closed position where the dispensing port is covered to an open position where the dispensing port is uncovered.

6 Claims, 5 Drawing Sheets

CONTAINER HAVING SLIDING DOOR

CROSS-REFERENCE TO RELATED PATENT APPLICATIONS

This patent application claims the benefit of U.S. Provisional Patent Application No. 60/836,769, filed Aug. 10, 2006, the entire teachings and disclosure of which are hereby incorporated in their entireties by reference thereto.

FIELD OF THE INVENTION

This invention generally relates to containers and, more particular, to containers having a moveable door for dispensing a product.

BACKGROUND OF THE INVENTION

Handheld containers are typically used for storing consumable and non-consumable items such as, for example, gum, mints, other candies, pills, and the like. There are many different varieties and types of handheld containers. While many have been satisfactory for one purpose or another, there is always a desire for further options, features, and improvements in the art to which the present invention is directed.

BRIEF SUMMARY OF THE INVENTION

The invention provides a container dimensioned and designed to be compatible with a hand and, more specifically, the palm of a hand. The container is uncomplicated to open and close and is, preferably, easily manipulated between closed and open positions (and back again) using a finger and/or thumb. Further, the container is able to repeatedly alternatively dispense and store products such as consumable tablets. By way of example, such consumable tablets include, but are not limited to, candy, gum, mints, pills, and the like.

In one aspect, the invention provides a container. The container includes a generally rectangular base, a generally rectangular cover, a dispensing port, and a slider. The generally rectangular base has a bottom, front and back walls extending upwardly from the bottom in spaced relation, and a pair of side walls extending upwardly from the bottom and transversely between the front and back walls to define a lower portion of a storage area. The generally rectangular cover has a top including a generally rectangular recess, front and back walls extending downwardly from the top in spaced relation, and a pair of side walls extending downwardly from the top and transversely between the front and back cover ends to define an upper portion of the storage area. The cover is operably coupled to the base to enclose the storage area. The dispensing port passes through the top of the cover within the recess. The slider is disposed within the recess and operably coupled to the cover. The slider is moveable within the recess from a closed position where the dispensing port is covered to an open position where the dispensing port is uncovered.

In another aspect, the invention provides a container having a base, a cover, and a slider. The cover is operably coupled to the base to form a storage area. The cover includes a recess having a pair of elongate slots and a dispensing port. The elongate slots and the dispensing port pass through the cover within the recess. The slider has a pair of guide members passing through one of the elongate slots. A distal end of each guide member extends into the storage area and is at least one of curled and folded to couple the slider and the cover. As such, the slider is moveable within the recess from a closed position where the dispensing port is covered to an open position where the dispensing port is uncovered.

In yet another aspect, the invention provides container having a container body, a recess, a dispensing port, and a slider. The container body has a bottom, a top, and a side wall extending transversely between and around the top and bottom to define a storage area. The recess is formed in the top and the dispensing port is formed through the top within the recess. The slider is received in the recess and is slideable between an open position wherein the dispensing port is exposed and a closed position wherein the dispensing portion is covered.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
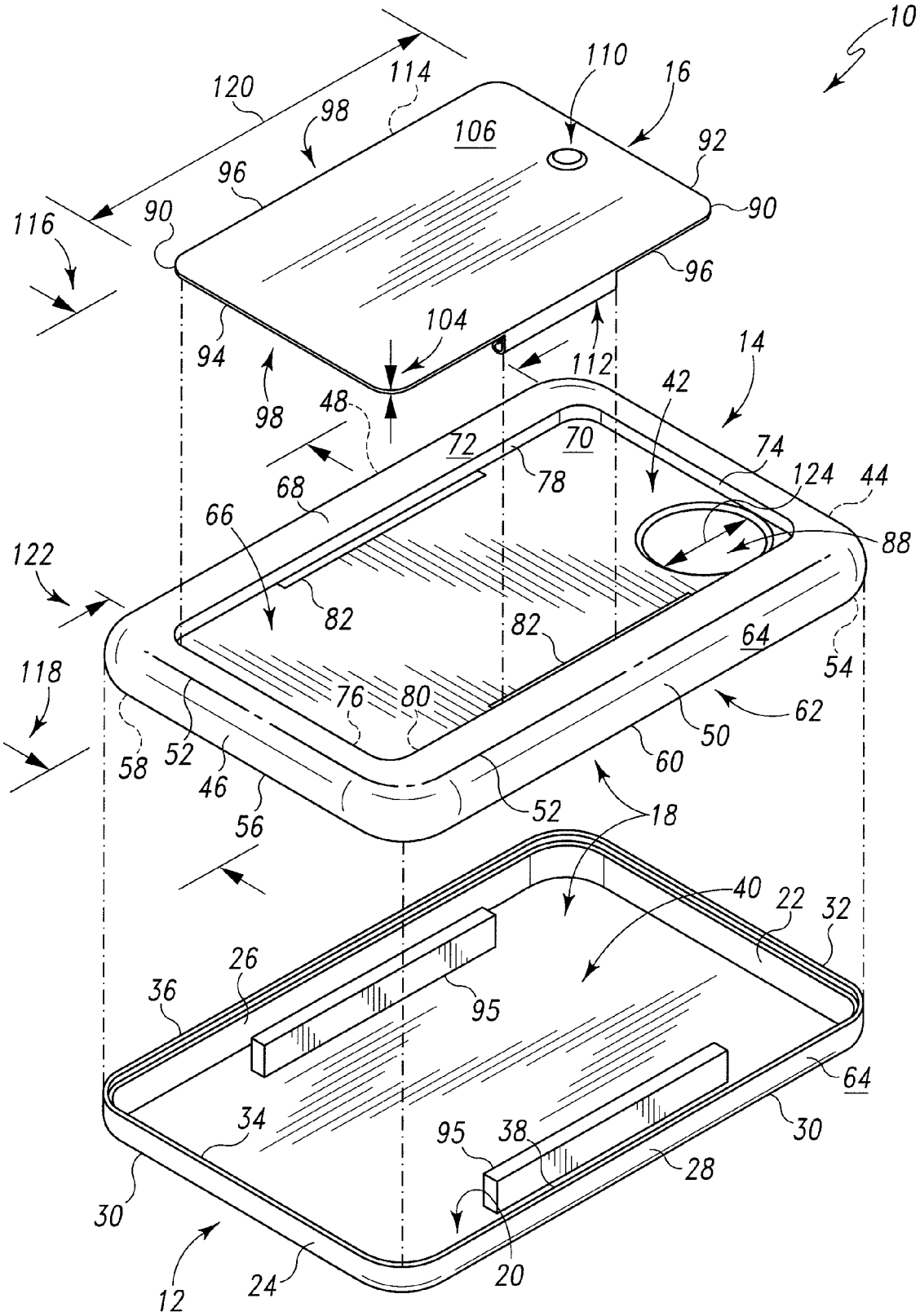
FIG. 1 is an exploded perspective view of an exemplary embodiment of a container constructed in accordance with the teachings of the present invention.

Referring to FIG. 1, a container 10 is illustrated. As will be explained more fully below, the container 10 is preferably dimensioned and designed to be compatible with a hand and, more specifically, the palm of a hand. The container 10 is uncomplicated to open and close and is, preferably, easily manipulated between closed and open positions (and back again) using a finger and/or thumb. Further, the container 10 is able to repeatedly alternatively dispense and store products such as consumable tablets. By way of example, such consumable tablets include, but are not limited to, candy, gum, mints, pills, and the like. As shown in FIG. 1, the container 10 comprises a base 12, a cover 14, a slider 16 (a.k.a., a door), and a storage area 18 disposed within the container.

The generally rectangular base 12 includes a bottom 20, front and back walls 22, 24, and a pair of side walls 26, 28. As shown, the bottom 20 is generally planar or flat. The front and back walls 22, 24 generally extend upwardly from the bottom 20 proximate a bottom periphery 30 and terminate in distal ends 32, 34. In the illustrated embodiment, the front and back walls 22, 24 are integrally formed with the bottom 20. Also, where the front and back walls 22, 24 are joined with the bottom 20 the base 12 is generally radiused to form a smooth, rounded surface. As shown, the front and back walls 22, 24 are generally transverse to, and spaced apart from each other by, the bottom 20.

The side walls 26, 28 also generally extend upwardly from the bottom 20 proximate the bottom periphery 30 and terminate in distal ends 36, 38. In the illustrated embodiment, the side walls 26, 28 are integrally formed with the bottom 20. Also, where the side walls 26, 28 are joined with the bottom 20 the base 12 is generally radiused to form a smooth, rounded surface. As shown, the side walls 26, 28 are generally transverse to the bottom 20, transverse to the front and back walls 22, 24, and spaced apart from each other by the bottom. As such, the base 12 generally forms a lower portion 40 of the storage area 18. The base 12 is preferably formed from plastic and is molded. However, a variety of other materials may be possible.

The generally rectangular cover 14 includes a top 42, front and back walls 44, 46, and a pair of side walls 48, 50. The front and back walls 44, 46 generally extend downwardly from the top 42 proximate a top periphery 52 and terminate in distal ends 54, 56. In the illustrated embodiment, the front and back walls 44, 46 are integrally formed with the top 42. Also, where the front and back walls 44, 46 are joined with the top 42 the cover 14 is generally radiused to form a smooth, rounded surface. As shown, the front and back walls 44, 46 are generally transverse to, and spaced apart from each other by, the top 42.

The side walls 48, 50 also generally extend downwardly from the top 42 proximate the top periphery 52 and terminate in distal ends 58, 60. In the illustrated embodiment, the side walls 48, 50 are integrally formed with the top 42. Also, where the side walls 48, 50 are joined with the top 42 the cover 14 is generally radiused to form a smooth, rounded surface. As shown, the side walls 48, 50 are generally transverse to the top 42, transverse to the front and back walls 44, 46, and spaced apart from each other by the top 42. The cover 14 generally forms an upper portion 62 of the storage area 18. In addition, the cover 14 is preferably formed from plastic and is molded. However, a variety of materials may be possible.

Figure 5:
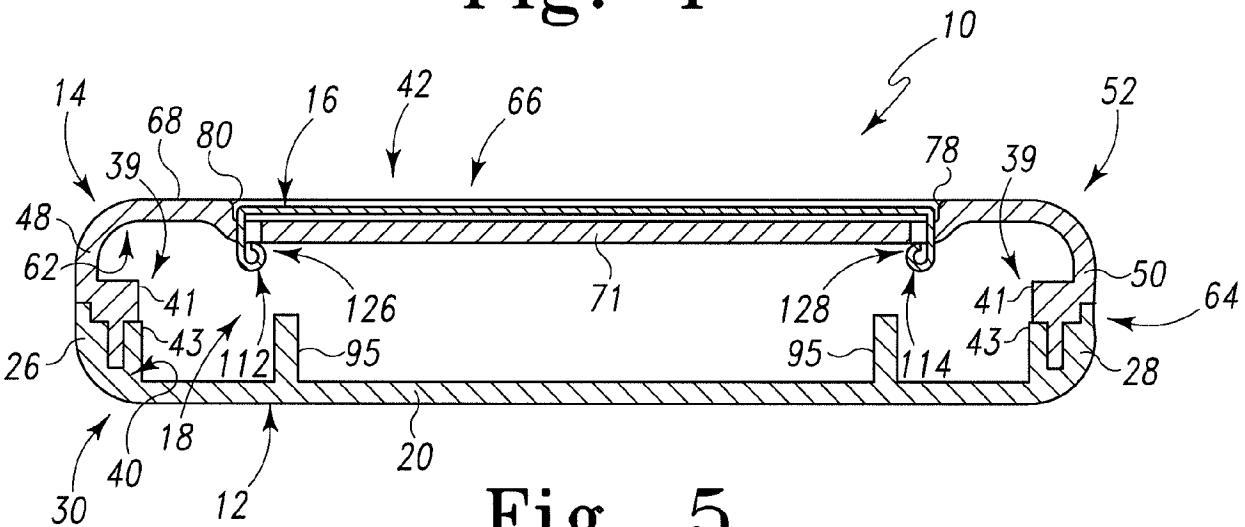
FIG. 5 is a cross sectional view of the container of FIG. 1 taken generally through and across the slots and the guide elements.

When operably coupled together, the base 12 and the cover 14 collectively form the storage area 18 found inside the container 10 of FIG. 1. The base 12 and the cover 14 are operably coupled together in a variety of different ways as well known to those skilled in the art. For example, in one embodiment, the base 12 and the cover 14 are operably coupled together by a friction fit (i.e., interference fit) and by mating axial flanges which may include interlocking snaps. As shown in FIG. 5, an interlocking mechanism 39 including pins 41 and barrels 43 may also be used in the alternative or in addition to other methods of securing the base 12 and cover 14. The base 12 and the cover 14 may be molded as separate parts of as a single, folded-over part whereby the base and the cover are unitarily connected together by a living hinge. Where the living hinge is used, a latch assembly is often employed to keep the cover and the base secured together. In yet another embodiment, the base 12 and the cover 14 are operably coupled by an adhesive, through ultrasonic bonding, and the like.

The base 12 and cover 14 preferably are permanently snapped together and thus not manually removable except with tool or extraordinary force. However, if a consumer desires to have ready access to the entire contents of the container 10, the base 12 and the cover can be releasably secured to each other. Preferably, the base 12 and the cover 14 are joined such that outer surfaces 64 of the container 10 between the top and bottom peripheries 52, 30 are generally smooth.

Still referring to FIG. 1, the top 42 of the cover 14 includes a generally rectangular recess 66 surrounded by a border 68. An upwardly-facing surface 70 of the top 42 within the recess 66 is disposed vertically below a top surface 72 of the border 68. Front and back recess walls 74, 76 and recess side walls 78, 80. The recess front and back walls 74, 76 and the recess side walls 78, 80 are generally transverse to each other and to the surfaces 70, 72. The recess 66 also preferably includes a recess bottom wall 71.

The top 42 also includes a pair of elongate, linear slots 82, which may be located in the recess 66. As shown, the slots 82 are formed within the recess 66 and through the top 42 proximate an intersection of the recess side walls 78, 80 and the upwardly-facing surface 70 of the recess 66. The slots 82 are generally parallel to each other and centrally located within the recess 66 between the recess front and back walls 74, 76. The slots 82 pass entirely through the top 42 and open up to the upper portion 62 of the storage area 18 within the container 10. Thus, no holes other than the dispensing port 88 may be in the top 42 and this avoids interference between the slider 16 and the contents of the container 10 held within the storage area 18 during movement of the slider.

Figure 2:
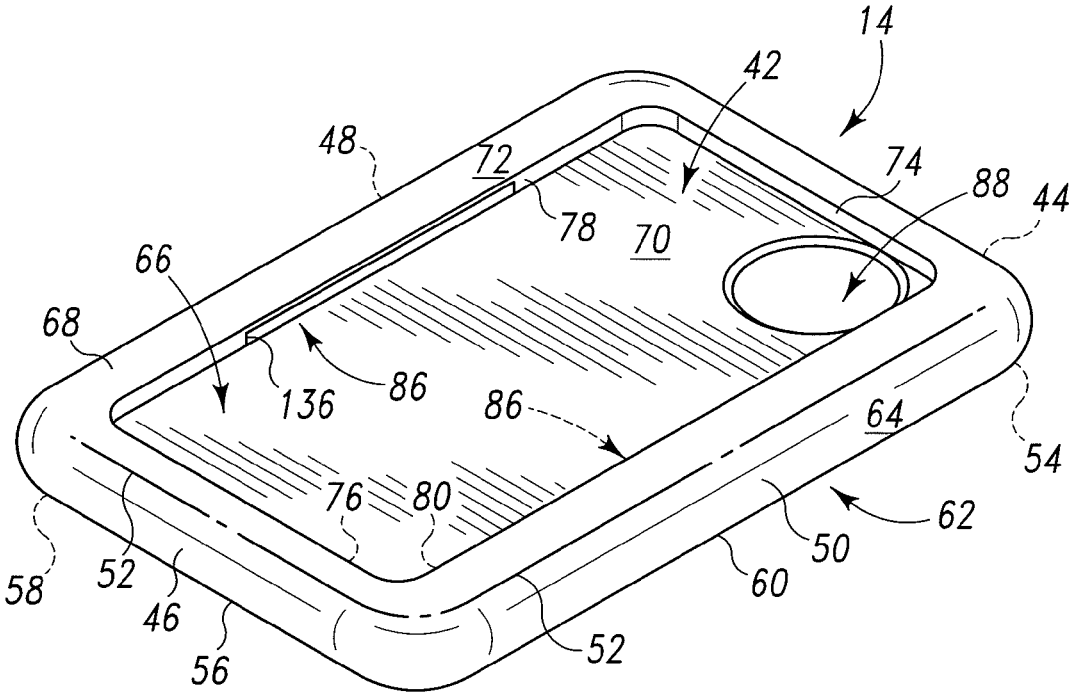
FIG. 2 is a perspective view of a second embodiment of a cover for use with the container of FIG. 1.

As illustrated in FIG. 2, in another embodiment the top 42 includes a pair of tracks 86 instead of slots 82. The tracks 86 are generally formed in the top 42 in a location similar to that of the slots 82 depicted in FIG. 1. However, the tracks 86 extend into the recess side walls 78, 80 and do not open up to the storage area 18.

Referring back to FIG. 1, the top 42 of the cover 14 includes a dispensing port 88. The dispensing port 88 is formed through the top 42 within the recess 66 and opens up to the storage area 18 within the container 10. The dispensing port 88 is sized, dimensioned, and otherwise configured to easily dispense the consumable tablets (not shown) held within the storage area 10 when the dispensing port is uncovered, as will be more fully explained below.

In the illustrated embodiment, the dispensing port 88 is located near the front wall 44 of the cover 14 and, in particular, proximate an intersection of one of the recess side walls 80 and recess front wall 74. In other words, the dispensing port 88 is generally situated in a corner of the recess 66. Also, in the illustrated embodiment, the dispensing port 88 is depicted as having a circular shape. However, other shapes are suitably employed such as, for example, square, rectangular, elliptical, triangular, and the like.

As depicted in FIG. 1, the slider 16 is generally rectangular, yet has rounded corners 90. The slider 90 is preferably formed from metal. Advantageously, this provides the look, design options, and lithography printing options available with metal (that are not available with plastic) while at the same time permitting a simple to mold plastic container 10 (not including the slider 16). When the slider is formed from metal, portions of the front and back ends 92, 94 and sides 96 of the slider 16 are folded over and/or crimped to ensure a smooth outer periphery 98 known as a safety edge. Other materials, including plastic, may be used for the slider 16.

Figure 3:
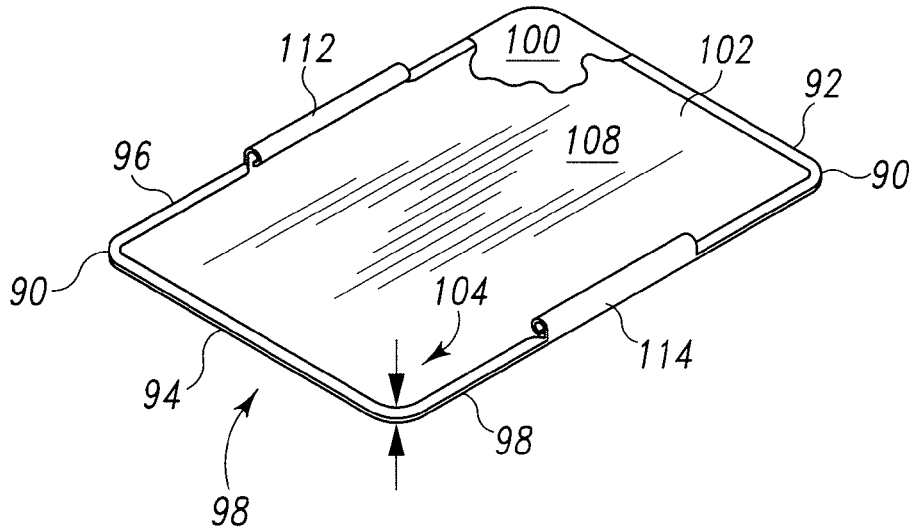
FIG. 3 is a back and bottom perspective view of the slider of FIG. 1.

In one embodiment as shown in FIG. 3, a bottom surface 100 of the slider 16 is coated or treated with a substance or material 102 (a portion of which has been removed for the purpose of illustration) having a reduced coefficient of friction relative to sheet metal. For example, the bottom surface 100 is coated with polytetrafluorethylene (PTFE), overlaid with a smooth finishing paint, and the like. In another embodiment, the material 102 overlaying the bottom surface 100 is in the form of a sheet or layer. The layer is held in place by the folded over and/or crimped portions of the front and back ends 92, 94 and sides 96 described above. If desired, an adhesive substance may alternatively or additionally be employed to secure the material 102 to the bottom surface. In addition to reducing drag between the slider 16 and surfaces the that slider moves over, as will be explained more fully below, the reduced friction material 102 permits the slider to have a more uniform overall thickness 104 from the top surface 106 of the slider to a bottom surface 108 of the material 102. In this manner, the crimped edges noted above will not substantially engage the surface 70.

Referring back to FIG. 1, the top surface 106 of the slider 16 includes a knurl 110 (or pattern of knurls) formed thereon and projecting upwardly away from the top surface. The knurl 110 provides a raised surface that permits a finger or thumb to grip the otherwise planar top surface 106 of the slider 16. As will be more fully explained below, the knurl 110 is employed when moving the slider 16 relative to the cover 14. In lieu of or in addition to the knurl 110, in one embodiment a debossed nib projecting downwardly into slider 16 away from the surface 106 with a corresponding recess on the surface 70 of the cover 14 could also be used to keep the container closed.

In one embodiment the top surface 106 of the slider 16 includes a lithographic image or print formed thereon. Again, this is an advantage of using metal for the slider 16. In the event plastic is used for the slider 16, the top surface 106 carries a label secured to the top surface by an adhesive. The image, print, and/or label is employed for marketing reasons to make the container 10 more aesthetically pleasing to a consumer and to convey information to the consumer about the contents.

The slider 16 also includes guide members 112, 114 that are integrally formed with the remainder of the slider. As illustrated in FIG. 5, the guide members 112, 114 begin proximate the sides 96 of the slider 16 and extend generally downwardly away from the bottom surface 100. The guide members 112, 114 are disposed approximately centrally between a front and back ends 92, 94 of the slider 16. To isolate or protect product within the storage area 18, the base 12 includes ribs 95 that project upwardly from the base within the lower storage area 40 as shown in FIGS. 1 and 5. The ribs 95 are generally parallel to the side walls 26, 28 and are unitarily formed with the base 12.

When the container 10 is fully assembled, the slider 16 is generally disposed within the recess 66 found in the top 42 of the cover 14. In that regard, with the exception of the knurl 110, the top surface 106 of the slider 16 is substantially coplanar with the border 72. In one embodiment, the top surface 106 of the slider 16, not including the knurl 110, does not project above the top surface 72 of the border 68. In another embodiment, the top surface 106 of the slider 16, not including the knurl 110, projects about one sixteenth of an inch or less above the top surface 72 of the border 68. Also, in one embodiment a rear portion of the border 72 is removed such that the back wall 76 is eliminated. Therefore, if the slots 82 or tracks 86 are of sufficient length, the slider 16 may be slid rearwardly until a portion of the slider projects outwardly and extends past the back wall 46 of the cover.

Further, as shown in FIG. 1, a width 116 of the slider 16 generally corresponds to a width 118 of the recess 66. However, a length 120 of the slider 16 is less than a length 122 of the recess 66. In fact, the difference between the two lengths 120, 122 is approximately equal to a diameter 124 (or largest expanse) of the dispensing port 88.

Figure 4:
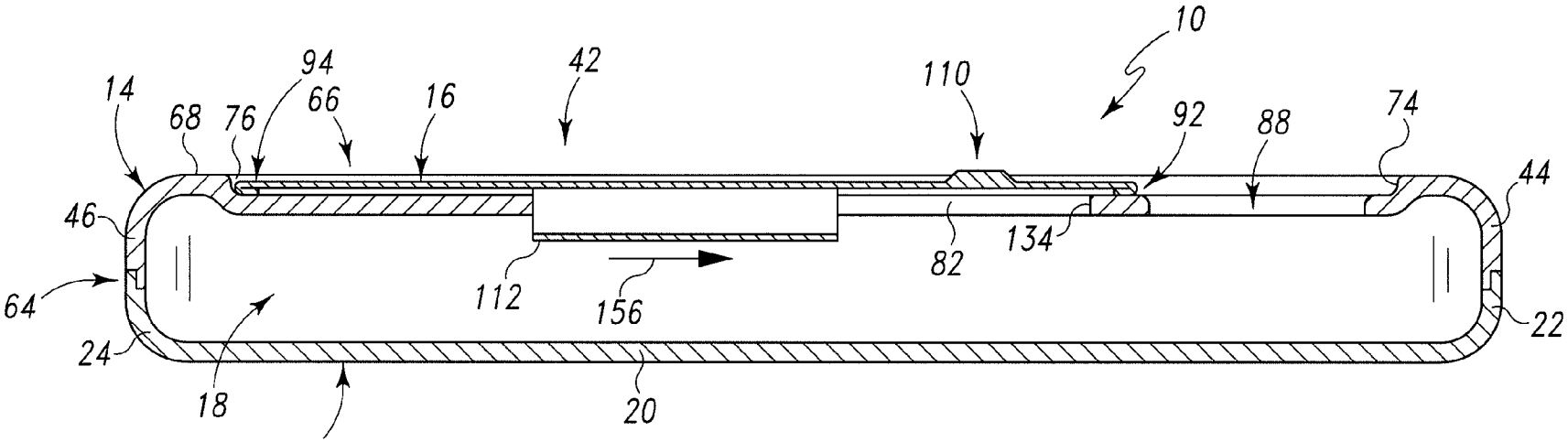
FIG. 4 is a cross sectional view of the container of FIG. 1 taken generally through and along a slot and a guide element.

In addition, the slider 16 is operably coupled to the cover 14 such that the slider is able to move back forth within the recess 66 toward and away from the front and back recess walls 74, 76. As depicted in FIGS. 4 and 5, in one embodiment the guide members 112, 114 of the slider 16 pass through the slots 82 in the cover 14 and extend into the storage area 18. As shown, the ends 126, 128 of the guide members 112, 114 are curled, folded, crimped, bent or otherwise configured to keep the slider 16 and the cover 14 secured together while still permitting relative movement between the two.

Figure 6:
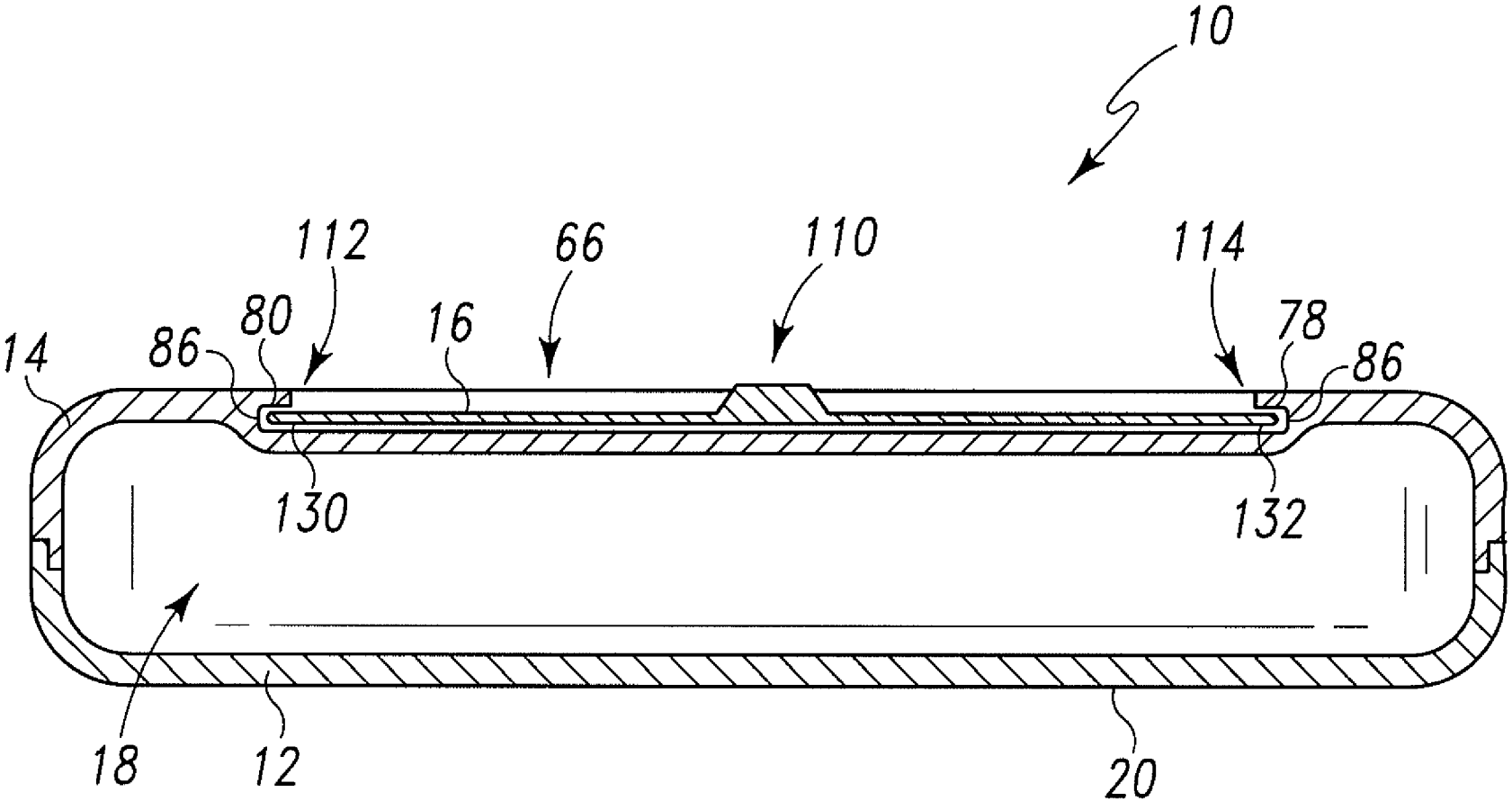
FIG. 6 is a cross sectional view of another embodiment of a slider for use with the cover of FIG. 2.

In the embodiment depicted in FIG. 6, the ends 130, 132 (a.k.a., extended safety edges) of the guide members 112, 114 of the slider 16 extend into and engage the tracks 86 to operably couple the slider to the cover 14. In such an embodiment, the ends 130, 132 of the guide members 112, 114 do not enter the storage area 18 and, as a result, have no direct contact with the consumable tablets temporarily stored therein. Even so, the slider 16 is still able to translate back and forth within the recess 66 or relative to the cover 14.

Figure 7:
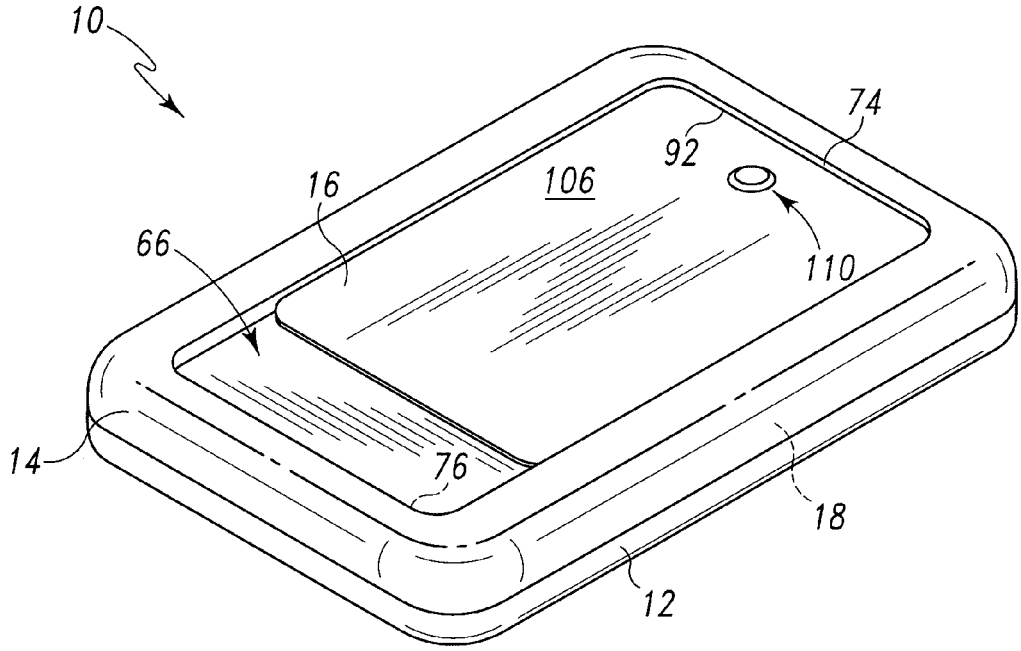
FIG. 7 is a back and top perspective view of the container of FIG. 1 in a closed position.

In operation, when the slider 16 and the container 10 are in the closed position as shown in FIG. 7, the front end 92 of the slider 16 is positioned proximate the front recess wall 74. As such, a forward portion of the slider 16 covers the dispensing port 88 (FIG. 1) and prevents the consumable tablets held within the storage area 18 from being dispensed. As shown, a portion of the recess 66 behind the slider 16 is exposed.

Figure 8:
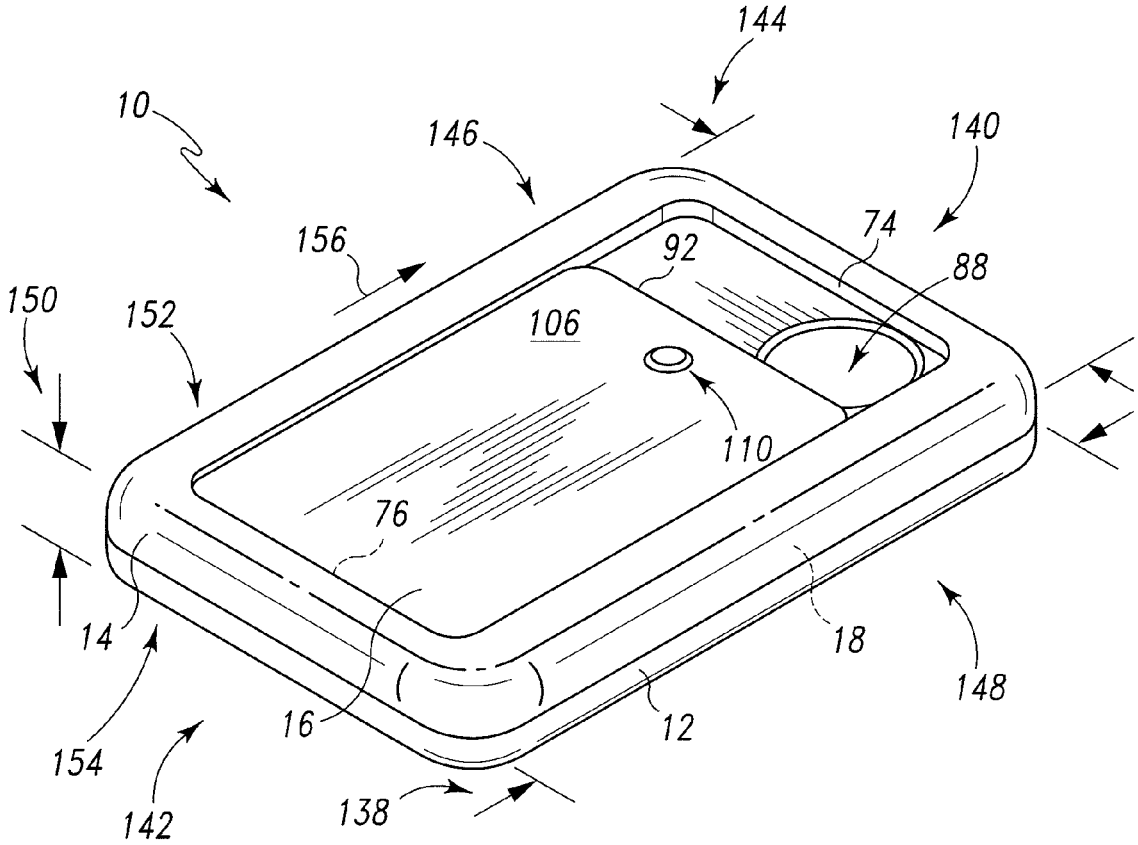
FIG. 8 is a back and top perspective view of the container of FIG. 1 in an open position.

To transition the slider 16 and the container 10 into the open position as shown in FIG. 8, the user of the container engages the knurl 110 on the top surface 106 of the slider 16 with a thumb or finger and applies a biasing force directed toward the back recess wall 76. When the biasing force exceeds the force of friction between the bottom surface 100 of the slider 16 (or the bottom surface 108 of the reduced friction material 102), the slider 16 begins to move toward the back recess wall 76. After the slider 16 has traveled a sufficient distance, the dispensing port 88 is exposed. Therefore, the dispensing port 88 is permitted to controllably dispense the consumable tablets held within the storage area 18.

To move the slider 16 back to the closed position, the user of the container again engages the knurl 110 on the top surface 106 of the slider 16 with a thumb or finger and applies a biasing force directed toward the front recess wall 74 (as shown by biasing force arrow 156 in FIGS. 4 and 8). When the biasing force exceeds the force of friction between the bottom surface 100 of the slider 16 (or the bottom surface 108 of the reduced friction layer 102), the slider 16 begins to move toward the front recess wall 74. After the slider 16 has traveled a sufficient distance, the dispensing port 88 is once again covered. Therefore, the dispensing port 88 is again prevented from dispensing the consumable tablets held within the storage area 18.

In one embodiment, as the slider 16 is transitioned between the open and closed positions, the slider employs the recess front wall 74, the recess back wall 76, a wall 134 within the slot 82 (see FIG. 4), and/or a wall 136 within the track 86 (see FIG. 2) as a stop to prevent further travel of the slider within the recess. The different potential stops are used either alone or in combination.

Also, in one embodiment friction is able to maintain the slider in either the closed position of FIG. 7 or the open position of FIG. 8 (or somewhere in between) after the slider 16 has been manipulated into those positions by the consumer. In other words, the friction existing between the slider 16 and the cover 14 is sufficient to prevent the slider from freely moving back and forth within the recess 66 until an external biasing force is exerted upon the knurl 110 by the consumer.

To provide hand-held ergonomic features suitable for typical tablet containers, and with reference to FIG. 8, the container 10 may have a length 138 from the front 140 to the back 142 of between about two and about four inches, a width 144 from one side 146 to an opposing side 148 of between about one and about three inches, and/or a thickness 150 from top 152 to bottom 154 of between about one quarter inch to about one inch.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

a base;

a cover operably coupled to the base to form a storage area, the cover including a recess having a pair of elongate slots and a dispensing port, the elongate slots and the dispensing port passing through the cover within the recess;

a slider having a pair of guide members passing through one of the elongate slots, a distal end of each guide member extending into the storage area and being at least one of curled and folded to couple the slider and the cover such that the slider is moveable within the recess from a closed position where the dispensing port is covered to an open position where the dispensing port is uncovered;

wherein, the recess and the slider each have a generally rectangular periphery, the periphery of the recess larger than that of the slider;

wherein, except for a knurl formed on the slider projecting upwardly away from the storage area, the slider is entirely disposed within the recess when the slider is in both the open and closed positions; and wherein, the slider is constructed of a sheet metal and defines a top surface, the top surface including a lithographic image and the knurl, the knurl permitting the top surface of the slider to be gripped when biasing the slider between the open and closed positions.

2. The container of claim 1, wherein at least one of a recess wall and a slot wall forms a stop for the slider.

3. A container comprising:

a generally rectangular base having a bottom, front and back walls extending upwardly from the bottom in spaced relation, and a pair of side walls extending upwardly from the bottom and transversely between the front and back walls to define a lower portion of a storage area;

a generally rectangular cover having a top including a generally rectangular recess, front and back walls extending downwardly from the top in spaced relation, and a pair of side walls extending downwardly from the top and transversely between the front and back cover ends to define an upper portion of the storage area, the cover operably coupled to the base to enclose the storage area;

a dispensing port passing of the cover within the recess;

a slider disposed within the recess and operably coupled to the cover, the slider moveable within the recess from a closed position where the dispensing port is covered to an open position where the dispensing port is uncovered;

wherein the slider comprises sheet metal and the base and cover comprise plastic;

wherein the top includes a pair of linear slots within the recess and the slider includes a pair of guide members, the guide members passing through the linear slots and deformed to operably couple the slider to the cover; and wherein the pair of linear slots extend through the top and the guide members pass through the linear slots and into the storage area.

4. The container of claim 3, wherein each of the pair of linear slots has a first width, and each of the pair of guide members includes an enlarged member having a second width greater than the first width, the enlarged member disposed within the storage area below the top.

5. A container comprising:

a container body having a bottom, a top, and a side wall extending transversely between and around the top and bottom to define a storage area;

a recess formed in the top;

a dispensing port formed through the top within the recess;

a slider received in the recess, the slider slideable between an open position wherein the dispensing port is exposed and a closed position wherein the dispensing portion is covered;

wherein the container body is formed from plastic and the slider is formed from sheet metal, the sheet metal slider having lithography thereof;

wherein a pair of parallel, linear slots are formed through the top within the recess proximate recess side walls and the slider includes a pair of guide members having distal ends, each distal end passing through one of the linear slots and being at least one of curled and folded to slideably couple the slider to the container base; and wherein each distal end is disposed within the storage area below the top.

6. The container of claim 5, wherein each of the pair of linear slots has a first width, and wherein each distal end forms a portion of an enlarged member having a second width greater than the first width, the enlarged member disposed within the storage area below the top.

* * * * *